US006035160A

United States Patent [19]

Kim

[11] Patent Number: 6,035,160

[45] Date of Patent: Mar. 7, 2000

[54] DEVICE FOR SEPARATING A HEAT ROLLER FROM A PRESSURE ROLLER IN A FIXING UNIT OF AN ELECTROPHOTOGRAPHIC MACHINE

[75] Inventor: Yong-Kook Kim, Songnam, Rep. of Korea

[73] Assignee: SamSung Electronics Co., Ltd., Kyungki-do, Rep. of Korea

[21] Appl. No.: 09/210,620

[22] Filed: Dec. 14, 1998

[30] Foreign Application Priority Data

Dec. 13, 1997 [KR] Rep. of Korea ..... 97-68460

[51] Int. Cl.[7] ..... G03G 15/20

[52] U.S. Cl. ..... 399/122; 399/328; 399/331; 219/216

[58] Field of Search ..... 399/328, 330, 399/331, 339, 122; 430/124, 126; 219/216

[56] References Cited

U.S. PATENT DOCUMENTS

| | | | |
|---|---|---|---|
| 3,809,861 | 5/1974 | Bruan | 219/469 |
| 4,598,990 | 7/1986 | Kusumoto et al. | 399/75 |
| 4,772,913 | 9/1988 | Watanabe | 399/321 |
| 5,023,667 | 6/1991 | Negoro et al. | 399/317 |
| 5,253,013 | 10/1993 | Takano et al. . | |
| 5,436,430 | 7/1995 | Baruch et al. . | |
| 5,493,377 | 2/1996 | Nishikawa et al. | 399/328 |
| 5,493,380 | 2/1996 | Saitou et al. . | |
| 5,572,307 | 11/1996 | Tomatsu et al. | 399/122 |
| 5,708,926 | 1/1998 | Sagara et al. . | |
| 5,785,440 | 7/1998 | Nishikawa et al. | 399/328 X |
| 5,835,835 | 11/1998 | Nishikawa et al. . | |
| 5,842,100 | 11/1998 | Yanashima et al. | 399/328 |
| 5,926,680 | 7/1999 | Yanamoto et al. | 399/328 |
| 5,956,547 | 9/1999 | Kamai et al. | 399/122 |
| 5,956,554 | 9/1999 | Yanashima et al. | 399/328 |

FOREIGN PATENT DOCUMENTS

| | | |
|---|---|---|
| 57-208580 | 12/1982 | Japan . |
| 58-023073 | 2/1983 | Japan . |
| 2-282773 | 11/1990 | Japan . |

*Primary Examiner*—Matthew S. Smith
*Attorney, Agent, or Firm*—Robert E. Bushnell, Esq.

[57] ABSTRACT

A roller separating device automatically separates a pressure roller from a heat roller when the rollers are unable to rotate or when a fixing operation is not in progress. The roller separating device includes an idle gear engaged with a pressure roller gear, a cam driving gear engaged with the idle gear, an electronic clutch fixed to a cam shaft to which a cam is also fixed. The electronic clutch is detachably coupled to the cam driving gear. The cam is driven by a driving force of a power gear and the electronic clutch couples/uncouples the driving force to the cam. When the electronic clutch is actuated, a driving force of the cam driving gear is transferred to the cam to move a pressure roller support frame so that the pressure roller is separated from the heat roller. When the electronic clutch is inactuated, the pressure roller support frame returns to its normal position by an elastic force of a spring so that the pressure roller contacts the heat roller.

11 Claims, 10 Drawing Sheets

DEVICE FOR SEPARATING A HEAT ROLLER FROM A PRESSURE ROLLER IN A FIXING UNIT OF AN ELECTROPHOTOGRAPHIC MACHINE

CLAIM OF PRIORITY

This application makes reference to, incorporates the same herein, and claims all benefits accruing under 35 U.S.C. §119 from an application for Device For Separating Rollers in Fixing Unit earlier filed in the Korean Industrial Property Office on Dec. 13, 1997 and there duly assigned Serial No. 68460/1997.

FIELD OF THE INVENTION

The present invention relates to a fixing unit of an electrophotographic image forming apparatus, and in particular, to a device for separating a pressure roller from a heat roller by using a driving force to prevent deformation of the pressure roller.

DESCRIPTION OF THE RELATED ART

However, in the conventional fixing unit, when the heat roller and the pressure roller having the halogen lamps are unable to rotate for a long time due to the paper jam, the pressure roller made of rubber may be permanently deformed at a portion in contact with the heat roller. The permanent deformation of the pressure roller may result in a unstable rotation of the heat roller, which degrades the image fixed to the sheet and makes a noise.

Fixing units that have detachable pressure roller from a heat roller are exemplified in U.S. Pat. No. 5,253,013 to Takano et al, entitled IMAGE RECORDING APPARATUS HAVING RELEASABLE FIXING DEVICE, U.S. Pat. No. 5,842,100 to Yanashima et al, entitled FIXING UNIT, U.S. Pat. No. 5,708,926 to Sagara et al, entitled IMAGE HEATING APPARATUS WITH FIRST AND SECOND ELASTIC MEMBERS, U.S. Pat. No. 5,493,380 to Saitou et al, entitled FIXING DEVICE WITH MEANS FOR LIMITING A DISTANCE BETWEEN HEATING AND PRESSING MEMBER, U.S. Pat. No. 5,436,430 to Barush et al, entitled ROLLER FUSER HAVING A TEMPERATURE CONTROL, and U.S. Pat. No. 5,835,835 to Nishikawa et al., entitled FIXING UNIT HAVING PRESS ROLLER OPENING/CLOSING MECHANISMS. However, none of these prior art references contain the exact same features as found in the present invention.

SUMMARY OF THE INVENTION

It is therefore an object of the present invention to provide a roller separating device for preventing deformation of a rubber pressure roller by automatically separating the pressure roller from a heat roller when the rollers are unable to rotate or when a fixing operation is not in progress.

It is further an object of the present invention to provide a fixing device that allows the pressure roller to become separated from the heat roller by using an electronic clutch, an idling gear, a rotatable cam, a cam driving gear, an idle gear, a pressure roller gear, a pressure roller support frame.

To achieve the above object, there is provided a device for separating rollers in a fixing unit. The fixing unit includes a heat roller support frame fixed to a main frame, a heat roller with a halogen lamp installed therein, the heat roller being supported by the heat roller support frame, a power gear engaged with a heat roller gear of the heat roller, a pressure roller gear engaged with a driving gear of the heat roller so that the heat roller can rotate keeping in contact with a pressure roller, a pressure roller support frame rotatably secured to shafts on the main frame, for supporting the pressure roller, guide ribs formed at inner and outer sides of a lower portion of the pressure roller support frame, and a pressing screw fixed to the main frame passing thruough a spring and the inner guide rib, the pressure roller keeping in contact with the heat roller by an elastic force of the spring. The roller separating device comprises an idle gear engaged with the pressure roller gear, a cam driving gear engaged with the idle gear, an electronic clutch fixed to a cam shaft to which a cam is also fixed, the electronic clutch being detachably coupled to the cam driving gear. The cam is driven by a driving force of the power gear and the electronic clutch couples and uncouples the driving force to the cam.

When the electronic clutch is actuated, a driving force of the cam driving gear is transferred to the cam to move the pressure roller support frame so that the pressure roller is separated from the heat roller. When the electronic clutch is inactuated, the pressure roller support frame returns to a normal position by the elastic force of the spring so that the pressure roller contacts the heat roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
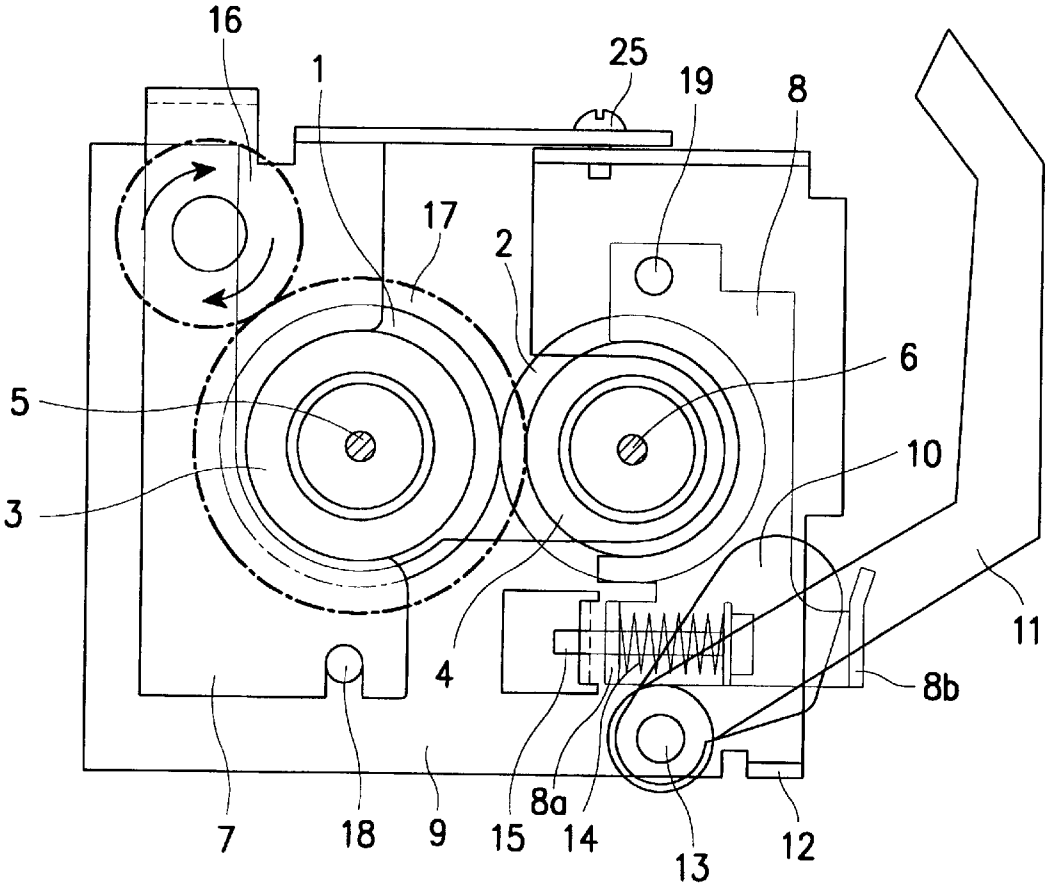
FIG. 1 is a front view of a fixing unit with a conventional roller separating device.
Figure 2:
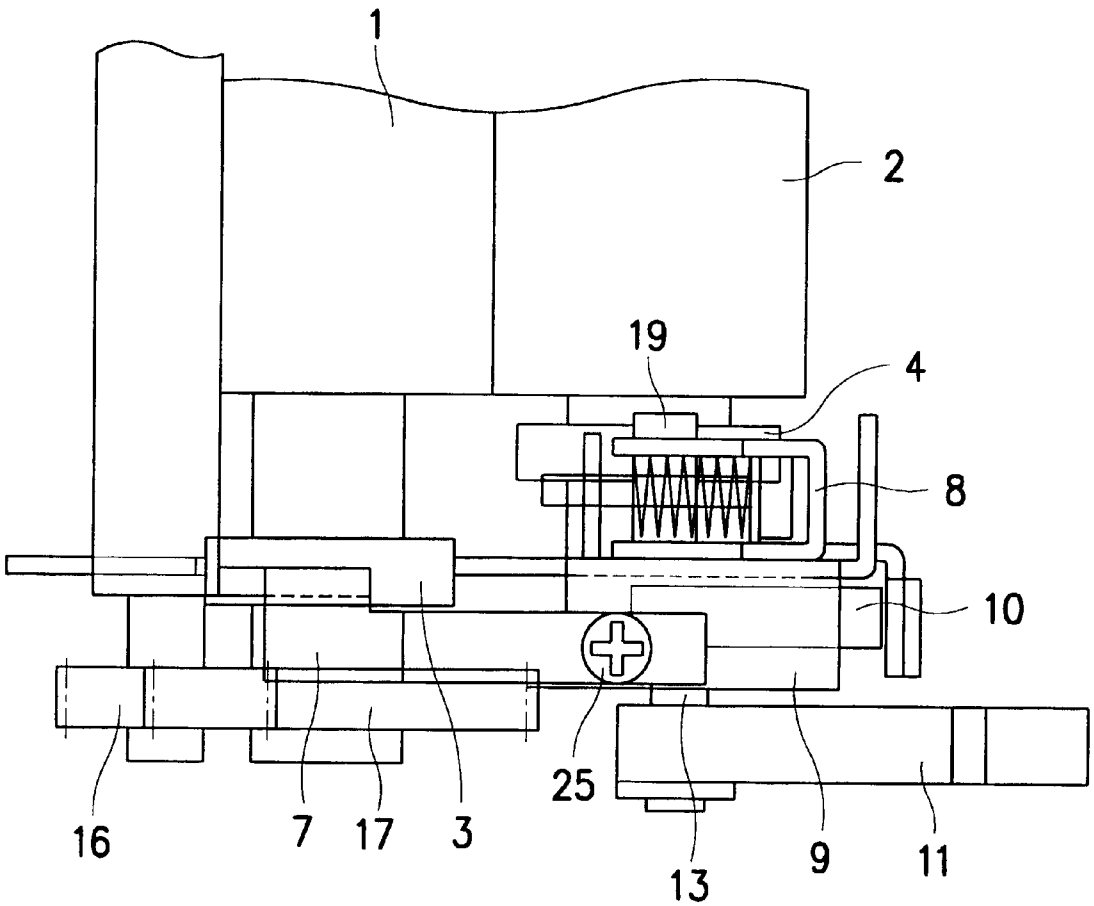
FIG. 2 is a top view of the fixing unit shown in FIG. 1.
Figure 3:
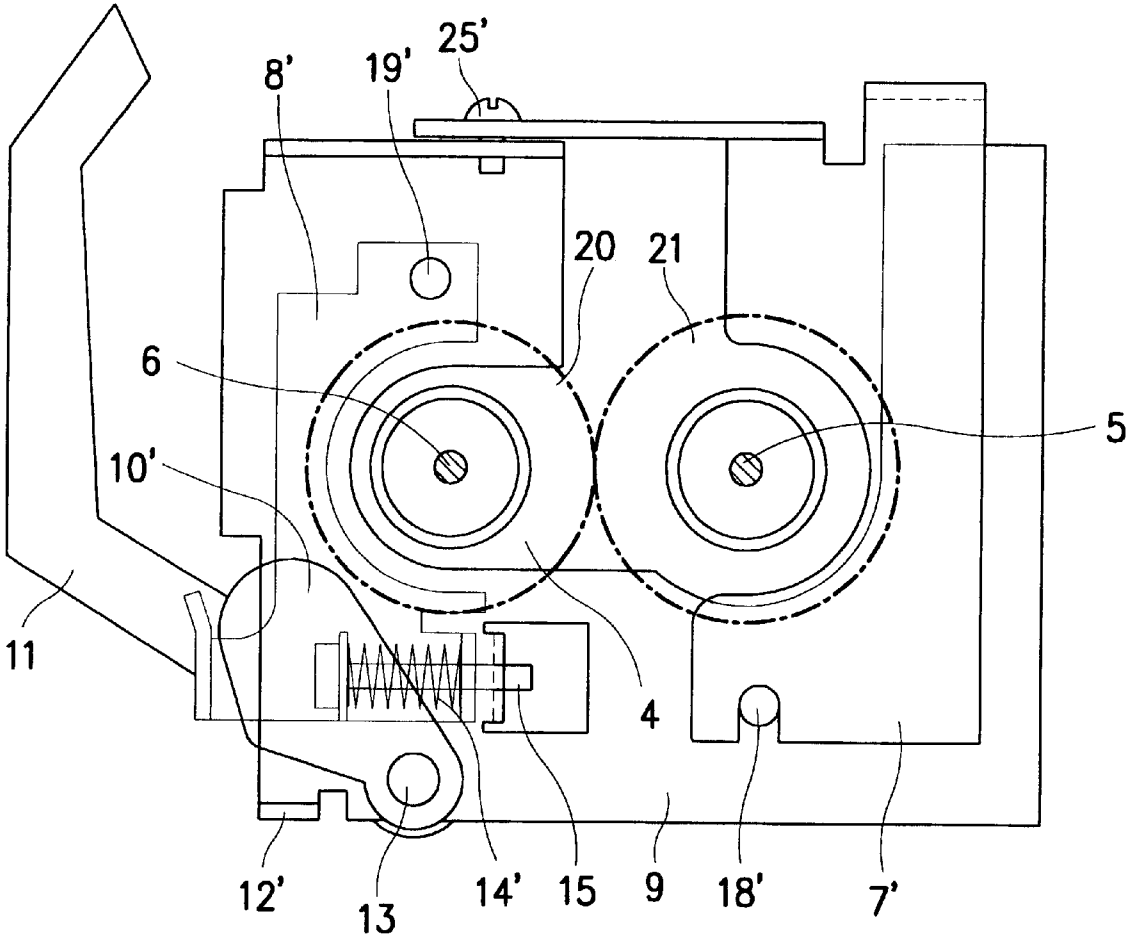
FIG. 3 is a rear view of the fixing unit with the conventional roller separating device.
Figure 4:
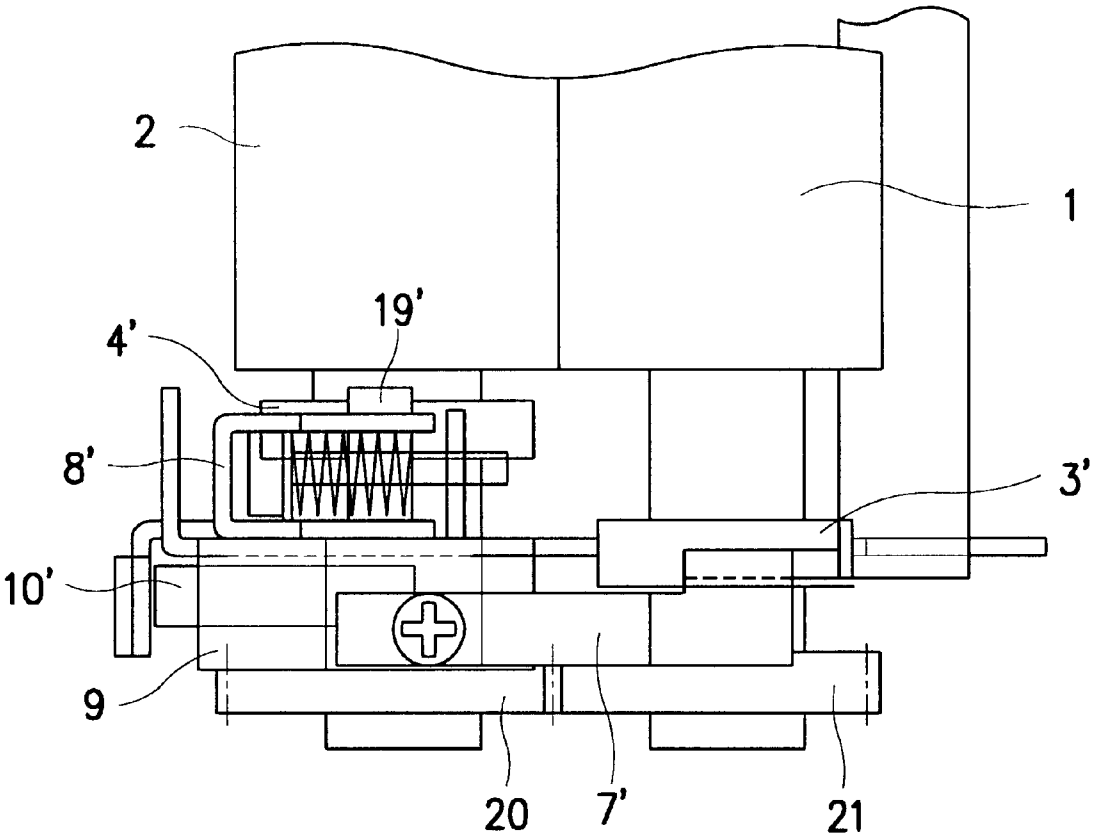
FIG. 4 is a top view of the fixing unit shown in FIG. 3.

A known fixing unit of an electrophotographic image forming apparatus such as a LBP (Laser Beam Printer) and a copier is illustrated in FIGS. 1 through 4. As illustrated, heat roller support frames 7 and 7' are fixed to either side of a main frame 9 of the fixing unit, by means of fixing screws 25 and 25' and fixing pins 18 and 18'. A heat roller 1 in which a halogen lamp 5 is installed, is disposed between the heat roller support frames 7 and 7'. A power gear 16 is engaged with a heat roller gear 17 of the heat roller 1. A driving gear 21 of the heat roller 1 is engaged with a pressure roller gear 20 so that the heat roller 1 and the pressure roller 2 may rotate in the opposite direction keeping in contact with each other. The pressure roller 2 is supported by pressure roller support frames 8 and 8' which are rotatably secured to shafts 19 and 19' of the main frame 9. The pressure roller support frames 8 and 8' each have guide ribs 8*a* and 8*b* formed respectively at inner and outer sides of the lower end thereof A pressing screw 15 is fixed to the main frame 9, passing through a coil spring 14 and the inner guide rib 8*a*, to enable the pressure roller 2 to closely contact the heat roller 1 by an elastic force of the coil spring 14.

At the lower end of the main frame 9, opposite cams 10 and 10' and a manual lever 11 are interlockingly fixed to a cam shaft 13. When the manual lever 11 moves downward, the cams 10 and 10' rotate to push out the outer guide rib 8*b* of the pressure roller support frame 8 and 8' so that the pressure roller 2 may be separated from the heat roller 1. The heat roller 1 and the pressure roller 2 have bearings 3 and 4 installed at either side thereof, respectively. The bearings 3 and 4 are supported by the heat roller support frame 7 and the pressure roller support frame 8, respectively. The pressure roller 2 also has a halogen lamp 6 installed therein. Under the cams 10 and 10', projections 12 and 12' for restricting rotation of the cams 10 and 10' are formed at the lower end of the main frame 9.

In operation, the power gear 16 drives the heat roller gear 17 to rotate the heat roller 1. Then, the driving gear 21 rotates the pressure roller gear 20 so that the heat roller 1 and the pressure roller 2 may rotate in the opposite direction keeping in close contact with each other. Thus, when a sheet travels between the heat roller 1 and the pressure roller 2, toner particles attached to the sheet can be fixed by the heat and pressure.

Figure 5:
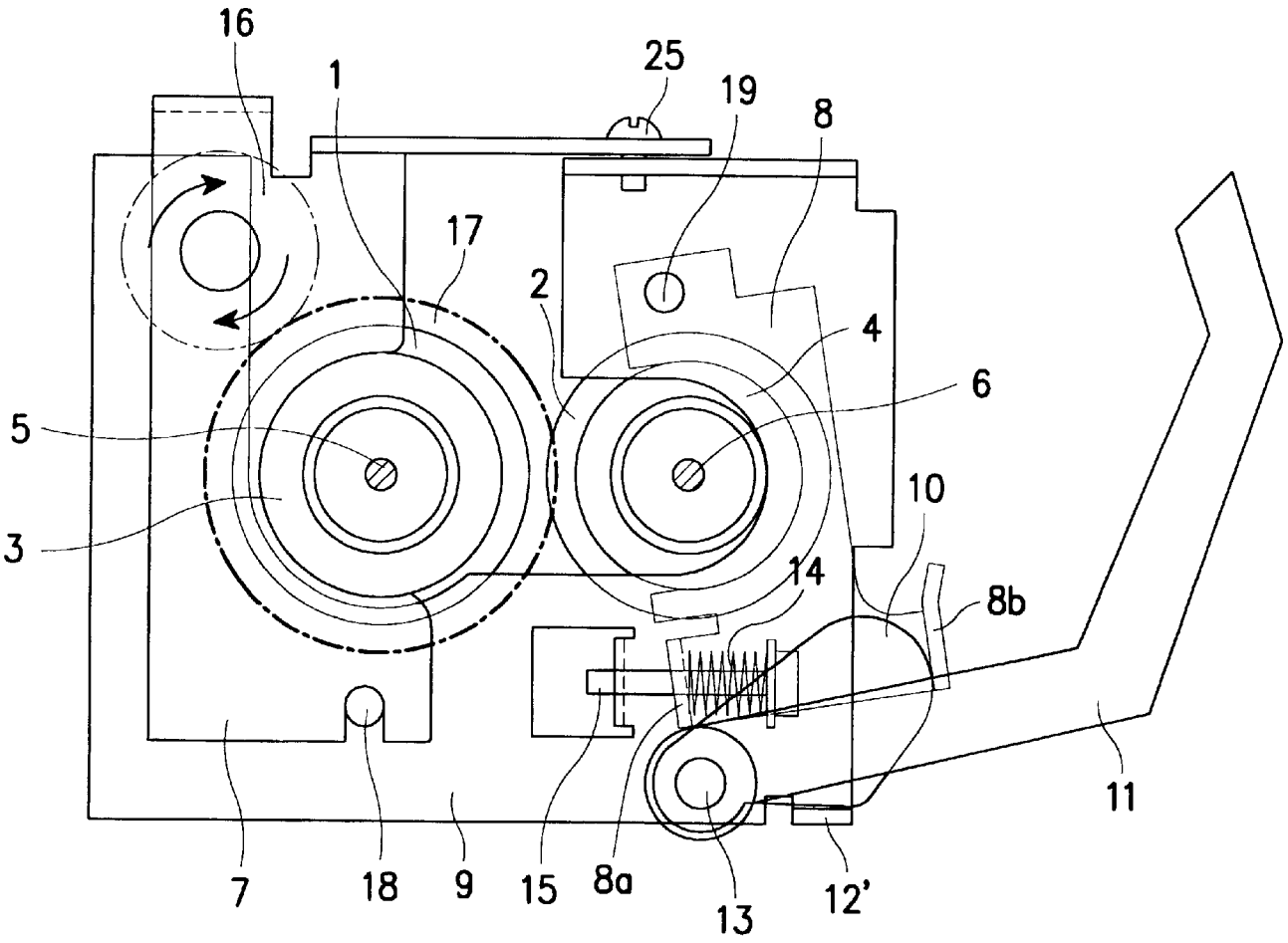
FIG. 5 is a front view of the fixing unit with the conventional roller separating device in a state where a pressure roller is separated from a heat roller.
Figure 6:
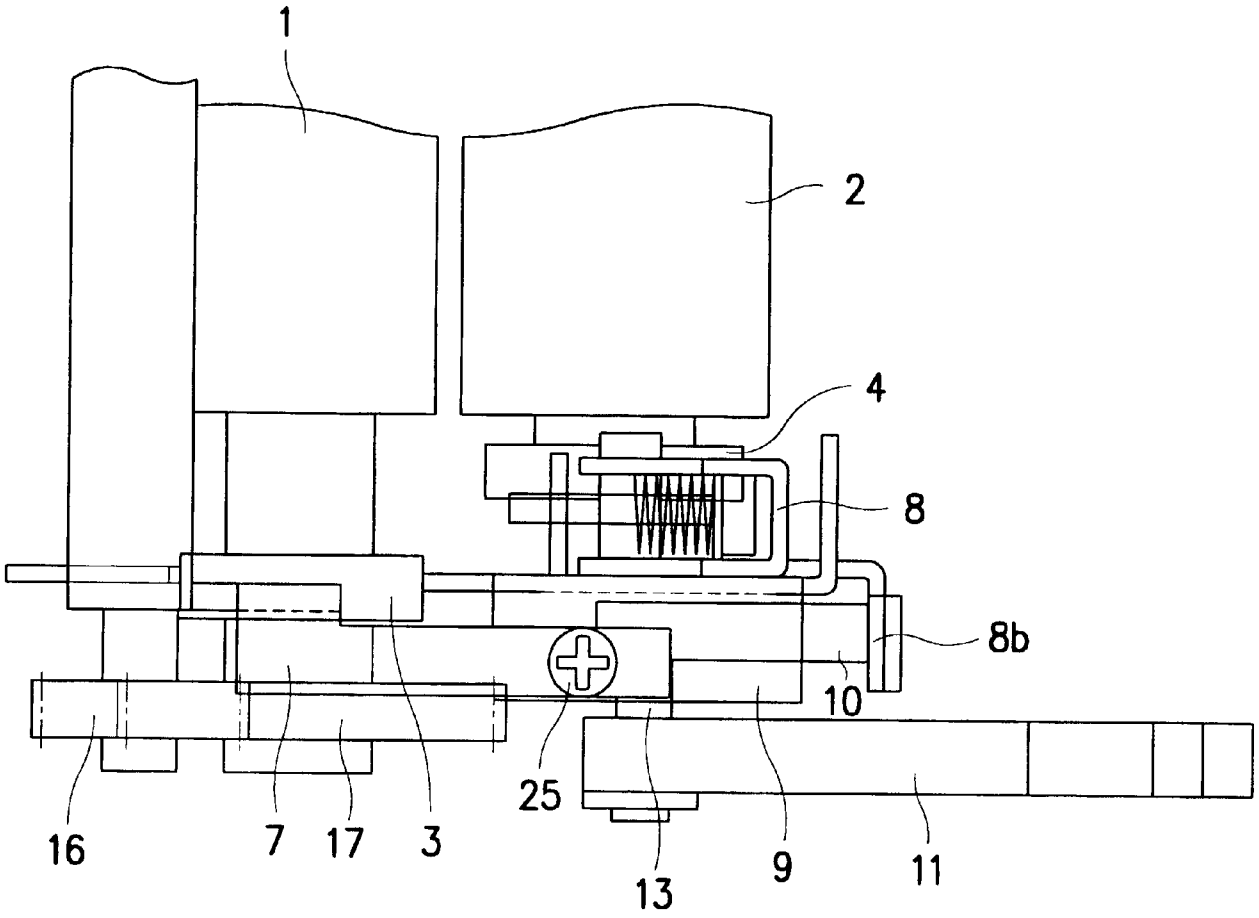
FIG. 6 is a top view of the fixing unit shown in FIG. 5.

During printing, if the sheet is jammed between the heat roller 1 and the pressure roller 2, a user will press down the manual lever 11 as shown in FIGS. 5 and 6, to remove the jammed sheet. Then, the cam 10 revolves on the cam shaft 13 to press out the outer guide rib 8*b* of the pressure roller support frame 8, so that the pressure roller support frame 8 revolves around the shaft 19, thereby separating the pressure roller 2 from the heat roller 1. At the moment, the coil spring 14 is compressed, because the pressure roller support frame 8 moves outward in the state where the pressing screw 15 is fixed to the main frame 9.

After separating the pressure roller 2 from the heat roller 1 in the above-mentioned manner, the user removes the jammed sheet by hand. After removing the jammed sheet, if the user puts back the manual lever 11 in its place, the pressure roller support frame 8 will move inward by a restitution force of the coil spring 14 secured to the pressing screw 15 so that the pressure roller 2 may contact the heat roller 1.

Figure 7:
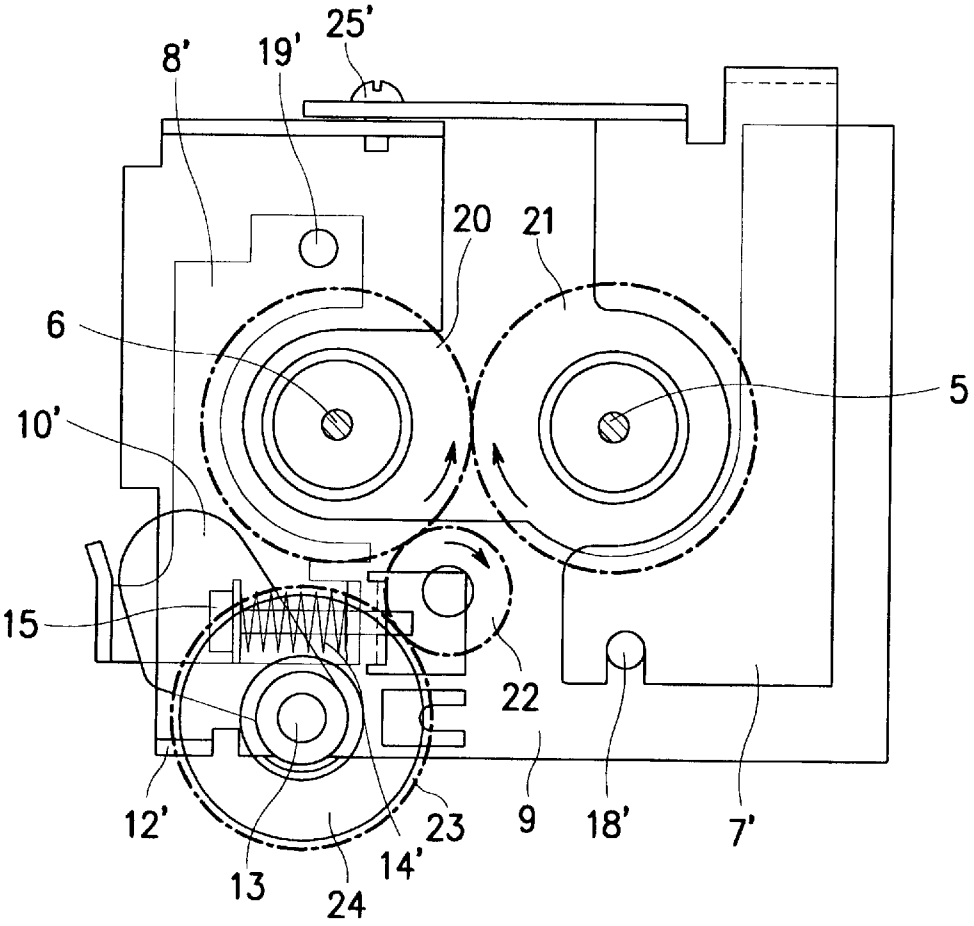
FIG. 7 is a rear view of a fixing unit with a roller separating device according to an embodiment of the present invention.
Figure 8:
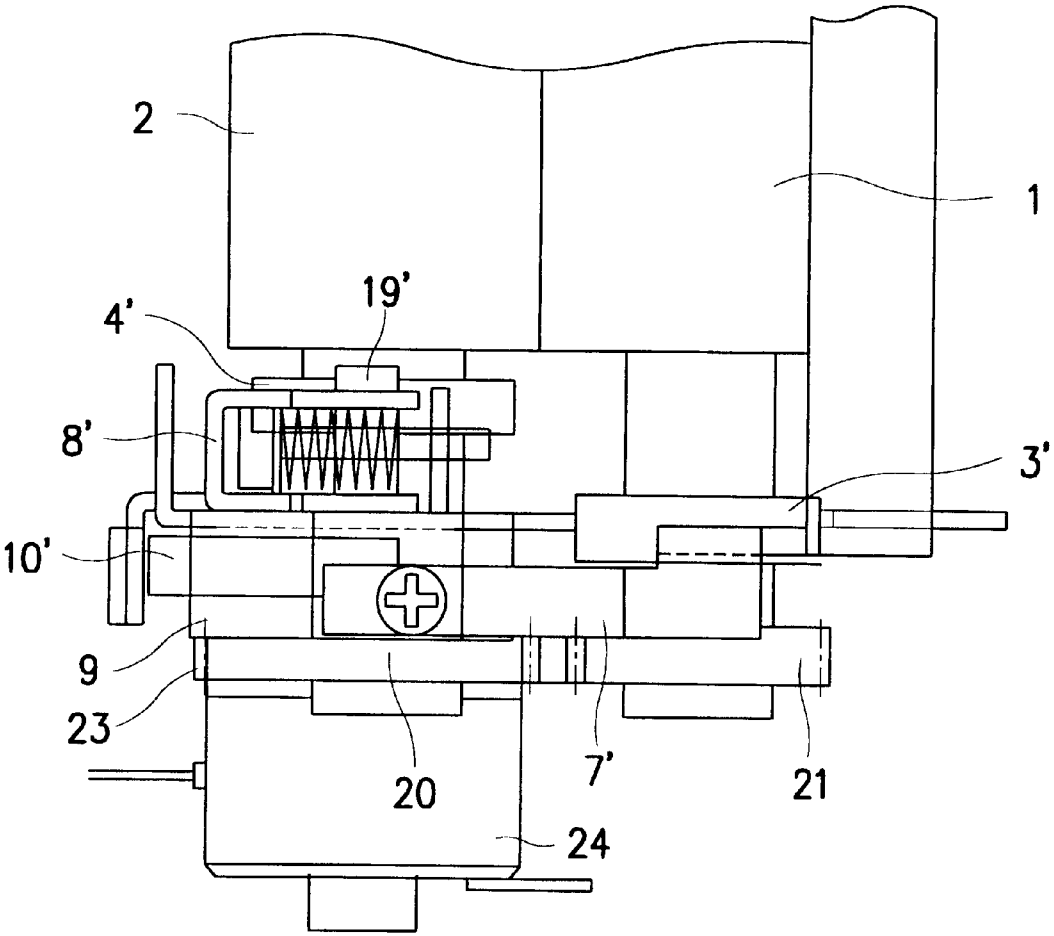
FIG. 8 is a top view of the fixing unit shown in FIG. 7.

FIG. 7 is a rear view of a fixing unit with a roller separating device according to an embodiment of the present invention, and FIG. 8 is a top view of the fixing unit shown in FIG. 7.

As illustrated, the fixing unit of the invention includes an idle gear 22, a cam driving gear 23 and an electronic clutch 24 in addition to the conventional structure, to automatically separate a pressure roller 2 from a heat roller 1.

Heat roller support frames 7 and 7' are fixed to either side of a main frame 9 of the fixing unit, by means of fixing screws 25 and 25' and fixing pins 18 and 18'. The heat roller 1 in which a halogen lamp 5 is installed, is disposed between the heat roller support frames 7 and 7'. A power gear 16 is engaged with a heat roller gear 17 of the heat roller 1. A driving gear 21 of the heat roller 1 is engaged with a pressure roller gear 20 so that the heat roller 1 and the pressure roller 2 may rotate in the opposite direction keeping in contact with each other. The pressure roller 2 is supported by pressure roller support frames 8 and 8' which are rotatably secured to shafts 19 and 19' of the main frame 9. The pressure roller support frames 8 and 8' each have guide ribs 8*a* and 8*b* formed respectively at inner and outer sides of the lower end thereof. A pressing screw 15 is fixed to the main frame 9, passing through a coil spring 14 and the inner guide rib 8*a*, to enable the pressure roller 2 to closely contact the heat roller 1 by an elastic force of the coil spring 14.

Under the pressure roller gear 20, the idle gear 22 is mounted on the main frame 9 such that the idle gear 22 should be engaged with the pressure roller gear 20. Further, the idle gear 22 is engaged with the cam driving gear 23 which is detachably mounted on the electronic clutch 24. The electronic clutch 24 is fixed to the cam shaft 13 where the cam 10 is also fixed. At user's option, a manual lever may be provided to the cam shaft 13.

In operation, the power gear 16 drives the heat roller gear 17 to rotate the heat roller 1. Then, the driving gear 21 rotates in engagement with the pressure roller gear 20 so that the heat roller 1 and the pressure roller 2 may rotate in the opposite direction keeping in close contact with each other. is Then, the idle gear 22 engaged with the pressure roller gear 20 rotates the cam driving gear 23 detachably mounted on the electronic clutch 24. In a normal state, the cam driving gear 23 is detached (uncoupled) from the electronic clutch 24 so that the cam driving gear 23 rotates idly. Thus, when a sheet travels between the heat roller 1 and the pressure roller 2, toner particles attached to the sheet can be fixed by the heat and pressure.

Figure 9:
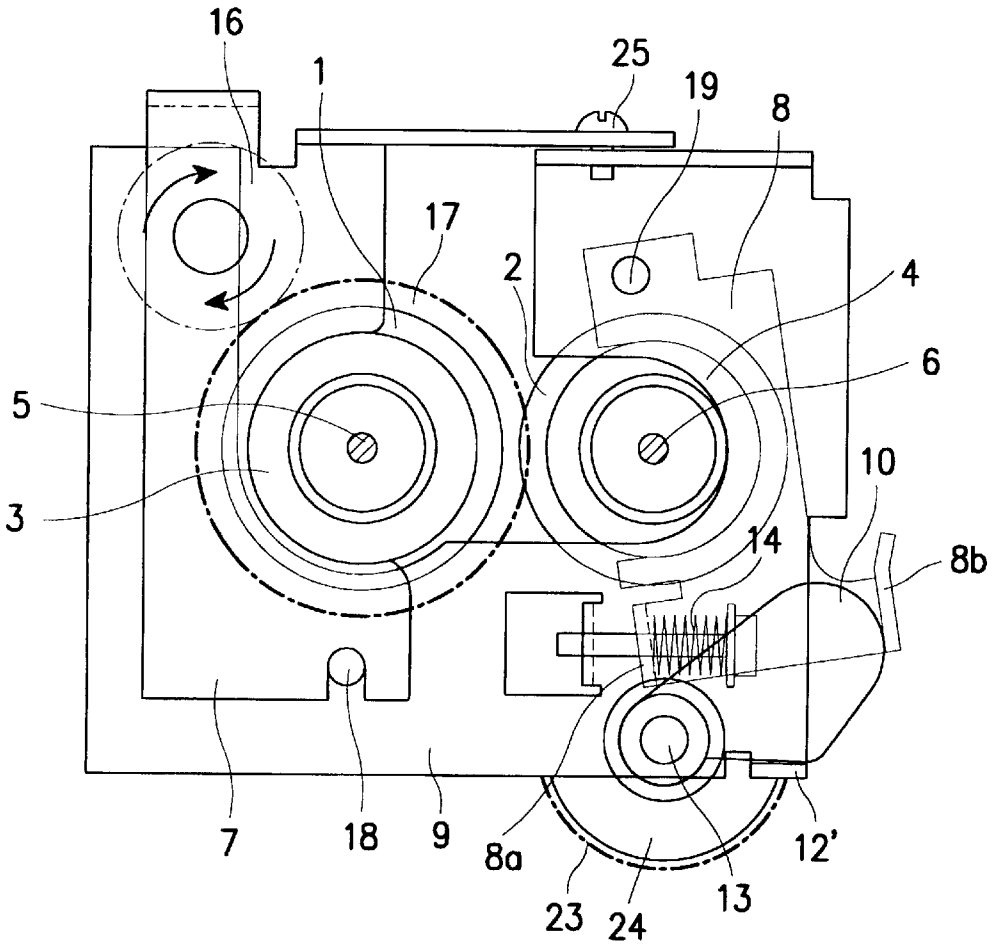
FIG. 9 is a front view of the fixing unit with the roller separating device in a state where the pressure roller is separated from the heat roller.
Figure 10:
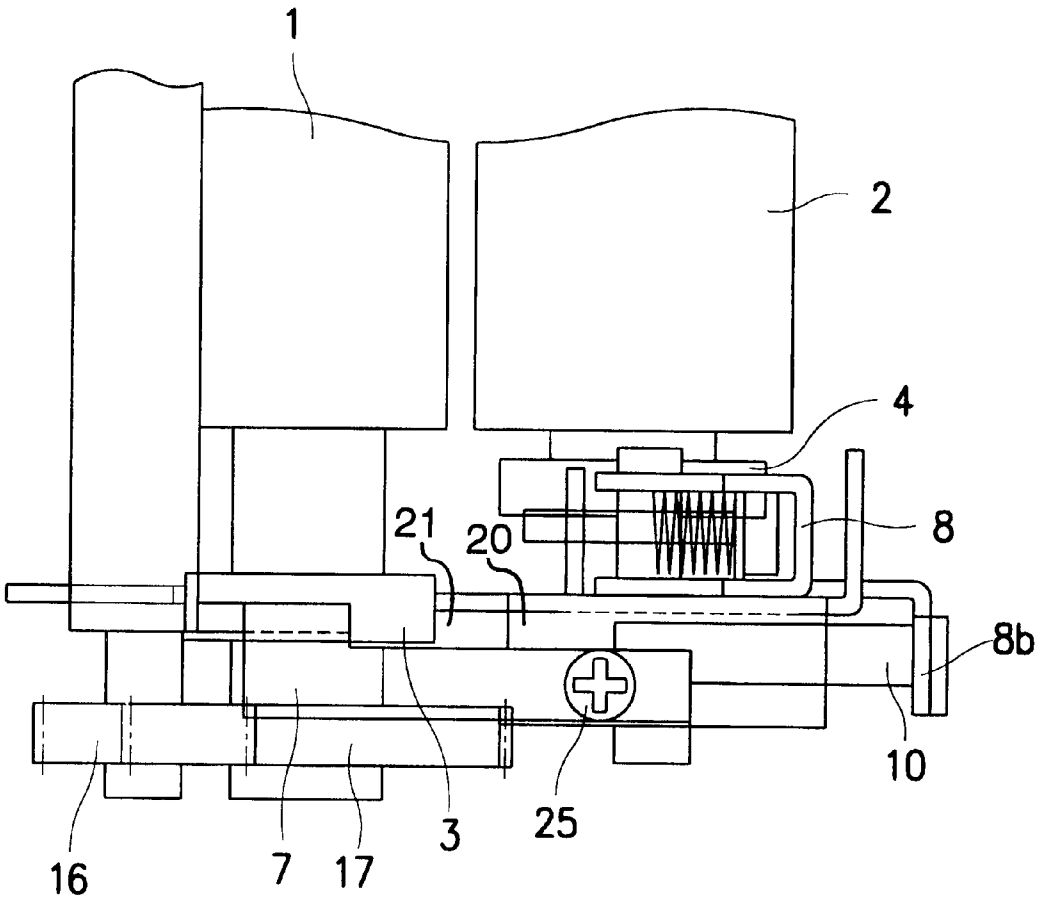
FIG. 10 is a top view of the fixing unit shown in FIG. 9.

In the meantime, if the fixing operation is not performed for a predetermined time because printing is ended (or the printing sheet is jammed), the fixing unit will automatically separate the pressure roller 2 from the heat roller 1 as illustrated in FIGS. 9 and 10, in response to a print end signal (or a paper jam signal) generated from a undepicted controller of the image forming apparatus. Specifically, while the heat roller gear 17, the driving gear 21, the pressure roller gear 20, the idle gear 22 and the cam driving gear 23 are rotated in sequence by the power gear 16, if the electronic clutch 24 is actuated in response to the print end signal, the electronic clutch 24 will be coupled to the cam driving gear 23 which was idly rotating. Then, a rotation force of the cam driving gear 23 is provided to the cam shaft 13 through the electronic clutch 24, so that the cam 10 may rotate to push out the outer guide rib 8*b* of the pressure roller support frame 8 where the pressure roller 2 is mounted. Here, the pressure roller support frame 8 revolves around the shaft 19, thereby separating the pressure roller 2 from the heat roller 1 and shutting off the driving force from the power gear 16. At the moment, the coil spring 14 is compressed, because the pressure roller support frame 8 moves outward in the state where the pressing screw 15 is fixed to the main frame 9.

Under the circumstance that the pressure roller 2 is separated from the heat roller 1 in the above-mentioned manner, if the printing sheet is fed again, the fixing unit inactuates the electronic clutch 24 in response to a print start signal (or a paper jam release signal) generated from the undepicted controller. Then, the electronic clutch 24 is uncoupled (or unclutched) from the cam driving gear 23 so that the cam shaft 13 with the cam 10 fixed thereto is independent of (or released from) the cam driving gear 23. As a result, the pressure roller support frame 8 will move inward by the elastic force of the coil spring 14 secured to the pressing screw 15 so that the pressure roller 2 may contact the heat roller 1. Subsequently, the power gear 16 provides the driving force to the pressure roller gear 20 via the hear roller gear 17, so that the heat roller 1 and the pressure roller 2 rotate keeping in contact with each other, to fix the toner image to the printing sheet.

As described above, the roller separating device of the invention automatically separates the pressure roller from the heat roller when the rollers are not rotated or when the fixing operation is not performed, thereby preventing deformation of the pressure roller.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A device for separating a pressure roller from a heat roller in a fixing unit in an electrophotographic device, comprising:

said heat roller attached to a support frame fixed to a main frame, said heat roller with a halogen lamp installed therein, the heat roller being supported by the heat roller support frame;

a power gear engaged with a heat roller gear of the heat roller, a pressure roller gear engaged with a driving gear of the heat roller so that the heat roller can rotate keeping in contact with a pressure roller;

a pressure roller support frame rotatably secured to shafts on the main frame, for supporting the pressure roller;

guide ribs formed at inner and outer sides of a lower portion of the pressure roller support frame;

a pressing screw fixed to the main frame passing through a spring and the inner guide rib, the pressure roller keeping in contact with the heat roller by an elastic force of the spring;

an idle gear engaged with the pressure roller gear;

a cam driving gear engaged with the idle gear; and an electronic clutch fixed to a cam shaft having a cam fixed thereto, the electronic clutch being detachably coupled to the cam driving gear.

2. The device as claimed in claim 1, wherein the cam is driven by a driving force of the power gear and the electronic clutch couples/uncouples the driving force to the cam.

3. The device as claimed in claim 1, wherein if the electronic clutch is actuated, a driving force of the cam driving gear is transferred to the cam to move the pressure roller support frame so that the pressure roller is separated from the heat roller, wherein if the electronic clutch is inactuated, the pressure roller support frame returns to a normal position by the elastic force of the spring so that the pressure roller contacts the heat roller.

4. The device as claimed in claim 3, wherein said spring is a coil spring.

5. A device for separating a heat roller from a pressure roller in a fixing unit of an electrophotographic machine, said device comprising:

a heat roller support frame attached to said heat roller;

a pressure roller support frame attached to said pressure roller, said pressure roller support frame capable of causing said pressure roller to come into contact with said heat roller or to cause said pressure roller to become separated from said heat roller;

a rotatable cam in sliding contact with said pressure roller support frame, said rotatable cam causing said pressure roller support frame to allow said pressure roller come into contact with or become separated from said heat roller;

an electronic clutch that causes said rotatable cam to rotate, allowing said pressure roller to come into contact with or become separated from said heat roller, wherein said electronic clutch is actuated causing said pressure roller to come into contact with said heat roller during a printing operation and causing said pressure roller to become separated from said heat roller when said electrophotographic machine is not in use or when a paper jam occurs, thus preserving the integrity of said pressure roller;

a cam driving gear being attached to said rotatable cam, said electronic clutch engages and disengages from said cam driving gear when said pressure roller is separated from or brought into contact with respectively said heat roller; and an idle gear that is positioned between said cam driving gear and a gear of said pressure roller, said idle gear being actuated by said gear of said pressure roller to drive said cam driving gear.

6. The device of claim 5, further comprising:

a coil spring biased to cause said pressure roller support frame to cause said pressure roller to come into contact with said heat roller.

7. The device of claim 6, wherein a halogen lamp is installed within said heat roller.

8. A method of detaching a pressure roller from a heat roller inside a fixing device of an electrophotographic machine, comprising the steps of:

providing a pressure roller gear attached to a pressure roller support frame;

engaging an idle gear attached to said pressure roller gear;

engaging a cam driving gear attached to said idle gear;

engaging a rotatable cam by said cam driving gear when an electronic clutch is actuated;

rotating said rotatable cam causing said pressure roller support frame to be moved away from said heat roller against a spring bias; and separating said pressure roller attached to said pressure roller support frame from said heat roller.

9. A method of removing a paper jam between a heat roller and a pressure roller in a fixing device of an electrophotographic machine, comprising the steps of:

rotating a power gear causing a heat rolling gear to rotate;

rotating said heat roller by way of said heat rolling gear;

rotating a driving ,ear about said heat roller by said heat roller;

rotating a pressure roller gear by way of said driving gear;

rotating said pressure roller by way of said pressure roller gear, said pressure roller and said heat roller being in contact with each other and rotating in opposite directions, said pressure roller attached to a pressure roller support frame which is attached to a coil spring that biases said pressure roller support frame to move said pressure roller into contact with said heat roller;

rotating an idle gear by way of said pressure roller gear;

rotating a cam driving gear by way of said idle gear;

signaling an electronic clutch upon the occurrence of a print end signal or a paper jam signal caused by a sheet of paper being processed between said heat roller and said pressure roller; and engaging said electronic clutch to cause said cam driving gear to rotate a cam into a guide rib attached to said pressure roller support frame, causing said cam to push, against said coil spring bias, said guide rib along with said pressure roller support frame to cause said pressure roller attached to said pressure roller support frame to separate from said heat roller causing said cam driving gear and said cam to cease rotating.

10. The method of claim 9, further comprising the step of removing said paper jam from between said heat roller and said pressure roller, causing said electronic clutch to disengage said cam driving gear from said cam causing said bias of said coil spring to push said pressure roller support frame along with said guide rib backwards so that said guide rib pushes back said cam and said pressure roller support frame moves back towards said heat roller causing said pressure roller to resume contact with said heat roller and causing said driving gear to contact, engage and rotate said pressure roller gear, causing said pressure roller gear to rotate said idle gear causing said idle gear to rotate said cam driving gear.

11. A method for engaging a pressure roller into contact with a heat roller of a fixing unit in an electrophotographic device, comprising:

providing a rotating driving gear about said heat roller;

providing a pressure roller gear about said pressure roller, providing a guide rib attached to a pressure roller support frame, said pressure roller gear being attached to said pressure roller support frame;

disengaging an electronic clutch causing a cam driving gear to disengage from a cam;

allowing a bias on a coil spring to cause said guide rib on said pressure roller support frame to push back said cam and to cause said pressure roller support frame to bring said pressure roller into contact with said heat roller and to cause said pressure roller gear to engage with said rotating driving gear causing said pressure roller gear to rotate;

causing an idle gear engaged with said pressure roller gear to rotate; and causing said cam driving gear, engaged with said idle gear, to rotate.

* * * * *